United States Patent [19]

Polinsky et al.

[11] Patent Number: 4,747,941

[45] **Date of Patent: * May 31, 1988**

[54] INCREASED REDUCTION OF MAGNESIUM CONTENT BY USE OF INORGANIC PROMOTERS DURING BENEFICIATION OF PHOSPHATE ORES BY FLOTATION

[75] Inventors: Samuel M. Polinsky; Laurence W. Bierman, both of Pocatello, Id.; David A. Hempel, Webster, S. Dak.

[73] Assignee: J. R. Simplot Company, Pocatello, Id.

[ * ] Notice: The portion of the term of this patent subsequent to Feb. 10, 2004 has been disclaimed.

[21] Appl. No.: 940,528

[22] Filed: Dec. 10, 1986

Related U.S. Application Data

[63] Continuation-in-part of Ser. No. 707,168, Feb. 28, 1985, Pat. No. 4,642,181, which is a continuation of Ser. No. 440,454, Nov. 10, 1982, abandoned.

[51] Int. Cl.[4] ..... B03B 1/02

[52] U.S. Cl. ..... 209/167; 252/61

[58] Field of Search ..... 209/166.167; 252/61

[56] References Cited

U.S. PATENT DOCUMENTS

| | | | |
|---|---|---|---|
| 4,287,053 | 9/1981 | Lehr | 209/167 |
| 4,317,715 | 3/1982 | Hintikka | 209/167 |
| 4,364,824 | 12/1982 | Snow | 209/167 |
| 4,425,229 | 1/1984 | Baron | 209/167 |
| 4,436,616 | 3/1984 | DuFour | 209/3 |
| 4,568,454 | 2/1986 | Mehrotra | 209/167 |
| 4,636,303 | 1/1987 | Hsieh | 209/167 |
| 4,642,181 | 2/1987 | Polinsky | 207/167 |

FOREIGN PATENT DOCUMENTS

| | | |
|---|---|---|
| 735517 | 5/1966 | Canada . |
| 825165 | 5/1981 | U.S.S.R. . |

OTHER PUBLICATIONS

Rule, Larson, and Daellenbach, "Application of Carbonate-Silica Flotation Techniques . . ." Dept. of Interior Report No. ALRC 81-60; 1981.

Dept. of Interior Technology News, Oct. 1982, "Increased Recovery from Western Phosphates."

Encyclopedia of Chemical Technology, vol. 6, pp. 595-613; 1951.

Perry & Chilton, Chemical Engineers Handbook, 5th edition, pp. 21-65 to 21-69.

McGraw Hill Encyclopedia of Science and Technology, vol. 5, 1960, pp. 312-315.

*Primary Examiner*—Kenneth M. Schor

*Assistant Examiner*—Thomas M. Lithgow

*Attorney, Agent, or Firm*—Gregory O. Garmong

[57] ABSTRACT

A process for beneficiating phosphate containing ores, wherein promoter reagents are added to the ore slurry prior to the addition of collectors and depressants for flotation of the carbonate and silica components. The promoters aid in increasing the rejection of the magnesium present during carbonate and silica flotation steps and recovery of phosphates, so that acceptably low magnesium levels for phosphoric acid production can be achieved in a phosphate concentrate in a single rougher stage. Preferred promoters include sodium carbonate and ammonium hydroxide.

8 Claims, No Drawings

INCREASED REDUCTION OF MAGNESIUM CONTENT BY USE OF INORGANIC PROMOTERS DURING BENEFICIATION OF PHOSPHATE ORES BY FLOTATION

BACKGROUND OF THE INVENTION

This invention relates generally to beneficiation of ores, and more particularly to a process including the addition of promoter reagents prior to carbonate-silica flotation, to achieve enhanced reduction of the magnesium content of phosphate-containing ores by flotation.

This application is a continuation in part of application Ser. No. 707,168, filed Feb. 28, 1985, now U.S. Pat. No. 4,642,181, which in turn is a continuation of application Ser. No. 440,454, filed Nov. 10, 1982, now abandoned.

Phosphoric acid for use as acid, fertilizer, or in producing other phosphorous-containing chemicals is prepared commercially from phosphate-bearing ores. The ores are mined and beneficiated to higher phosphate and lower impurity concentrations and then processed to phosphoric acid by any of several techniques. In a typical flotation process to beneficiate a slurry of the ore in water, the ore is prepared by comminuting and sizing to a range of fine-sized particles, flotation reagents are added to the slurry and the particles of the desired and undesired species are separated into a concentrate portion and a tailing portion, respectively, by flotation to achieve the initial stages of purification of the phosphate ore concentrate.

Flotation is based upon the principle that a slurry of ore in water may be chemically treated by flotation reagents so that air bubbles will selectively adhere to particles of a selected species, causing them to float to the surface. In a typical flotation process, a chemical collector is added to the slurry to activate the surface of those particles to be removed from the slurry, thereby rendering the particles hydrophobic, and air is bubbled through the slurry. The bubbles adhere to the activated particles, which float upwardly to the surface of the slurry with the bubbles. A foam containing the floated species is then skimmed from the upper surface of the slurry as an overflow from the flotation unit. A selective depressant may be added to the slurry with the collector to render other species hydrophilic so that bubbles will not adhere to those particles, and the depressed species will not float but instead remain in the slurry. The underflow, or nonfloated species, is then removed, either continuously or in batch fashion, for further beneficiation or processing into acid.

The beneficiation steps required depend upon the impurity constituents of the ore, which in turn may vary regionally from mine to mine. As an example, several mining locations throughout the United States yield a phosphate ore containing a low level of magnesium impurity, and also commonly containing carbonate and silica impurities. A high level of magnesium impurity in the phosphate ore is particularly undesirable, as it produces undesirable precipitates in the final phosphoric acid products and increases caking in dry phosphate products. Therefore, low-magnesium phosphate ores are most desirable in preparing phosphoric acid, and historically these ores have been mined first wherever available. The high magnesium phosphate ores have typically been avoided, discarded or used only sparingly by blending them with low-magnesium ores to achieve an overall product meeting desired magnesium limits. In recent years the low-magnesium ores have been exhausted or are approaching exhaustion in many locations, and it has become necessary to develop a process for beneficiating high-magnesium phosphate ores.

One process for beneficiating phosphate ores by flotation provides for an addition of a fatty acid collector and a fluosilicic acid phosphate depressant to a sized slurry of ore in water, a first flotation of carbonate impurities, addition of amines, and finally a second flotation of silica impurities. Magnesium is removed primarily with the carbonate impurities. This process achieves acceptable recovery rates and concentration of the phosphate values, but only relatively small rejection of the magnesium found in the feed ore. When this process is applied to feed ores having low magnesium contents, the minor reduction in magnesium during the beneficiation process may still produce an acceptable product for use in manufacturing phosphoric acid. However, when the feed material contains larger amounts of magnesium, above about 1.2 percent MgO, or when it is desired to achieve greater magnesium reductions in low-magnesium phosphate ores, this process is found to be unacceptable in that too large a magnesium content remains in the phosphate concentrate. Other processes also exist using different depressants and collectors. However, these produce similar results.

Accordingly, there has been a need for a process to recover phosphates and reject larger amounts of magnesium during beneficiation of phosphate ores containing magnesium impurities. The need is particularly acute as low-magnesium phosphate ores become unavailable, and highmagnesium phosphate ores must be used increasingly in the future. The present invention fulfills this need, and further provides related advantages.

SUMMARY OF THE INVENTION

The present invention provides a process for beneficiation of phosphate-containing ores to achieve acceptable magnesium levels and phosphate concentrations, through an aqueous conditioning treatment with promoters prior to carbonate and silica flotation. In accordance with the invention, the promoters are added during the aqueous conditioning treatment to condition the slurry and reduce inhibition of depression of phosphate flotation. Preferably, the promoters include ammonia added as ammonium hydroxide, and a soluble carbonate, most preferably sodium carbonate. With this invention, recoveries of about 70 percent phosphate with the rejection of over 90 percent MgO may be achieved in a single rougher stage with a 2.5 percent MgO dolomitic phosphate ore feed, and in addition the necessity of removing nearly all undersized particles before flotation is not as critical. Thus, in a single rougher stage high-magnesium phosphate ores may be sufficiently beneficiated to serve as the input material for commercial grade phosphoric acid production.

It will be appreciated that the present invention represents a significant advance in the beneficiation of high-magnesium phosphate ores for use in preparing phosphoric acid. With this process, phosphate ores containing over 1.2 percent MgO may be beneficiated in a single rougher stage to recover a high percentage of the phosphate while rejecting a large fraction of the magnesium impurity so that the phosphate ore concentrate remaining may be processed into an acceptable phosphoric acid. Thus, high-magnesium phosphate ores, which previously have been discarded or used only sparingly, may be economically beneficiated for use in preparing phosphoric acid. Consequently, new supplies of phosphate ores may be considered for commercial operations, and large amounts of previously discarded ores at existing mines may now be processed to recover their phosphate values.

Other features and advantages of the present invention will become apparent from the following more detailed description, which describes, by way of example, the principles of the invention.

DETAILED DESCRIPTION OF THE PREFERRED EMBODIMENT

A process for the beneficiation of phosphate ores has been reported by the United States Bureau of Mines in report ALRC 81-60, "Application of Carbonate-Silica Flotation Techniques to Western Phosphate Materials," by A. R. Rule, D. E. Larson, and C. B. Daellenbach. Briefly, in the Bureau of Mines process, the phosphate ore in a water slurry is first comminuted and sized so that the particles lie in the range 20 microns–106 microns. Particles smaller than 20 microns must be removed and discarded in a process step such as a hydrocyclone separator. A fatty acid and a fluosilicic acid are then added to the sized ore slurry under agitation. The fatty acid renders the surface of the carbonate material in the slurry hydrophobic, while the fluosilicic acid renders the surface of the phosphate mineral hydrophilic to prevent adsorption of the fatty acid. A frothing agent is added to the slurry, and the carbonate and phosphate components are then separated by flotation of the carbonates. The magnesium removed is primarily separated in the carbonate flotation step, although the absolute amount of magnesium removed is relatively small. Following the carbonate flotation, an amine reagent is added as a collector for selective flotation of the silica component from the phosphate without any further slurry preparation. The silica is then separated from the phosphate values in a silica flotation, and the phosphate concentrate is dewatered for use in preparation of phosphoric acid.

Although the Bureau of Mines process achieves acceptable results on phosphate-containing ores having less than about 1.2 percent MgO, it has been found that the process does not reject a sufficiently high amount of magnesium to be utilized for beneficiation of ores having significantly more than about 1.2 percent MgO. For use in phosphoric acid preparation, the beneficiated phosphate ore concentrate is preferred to contain less than about 0.7 percent MgO. The Bureau of Mines report ALRC 81-60 indicates that the Bureau of Mines process removes about 0.3–0.4 percent MgO when used with an initial feed material containing about 1.0 percent MgO, thus reaching a marginal level in regard to the MgO content. In applying the Bureau of Mines process to a phosphate ore containing a higher magnesium content, about 1.45 percent MgO, applicants have found that the absolute amount of reduction of MgO is approximately the same, or about 0.3 percent MgO. The resulting beneficiated phosphate ore contains about 1.1–1.2 percent MgO after a single rougher stage flotation in accordance with the Bureau of Mines process, an MgO level which is commonly considered unacceptably high for production of phosphoric acid. Therefore, use of the Bureau of Mines process in beneficiating such high magnesium phosphate ores would require additional cleaner flotation stages or other modifications.

In accordance with the invention, prior to the addition of the fatty acid and fluosilicic acid, promoter reagents are added to the ore slurry, to provide an environment conducive to the depression of the phosphate values and enhancement of the carbonate flotation. Preferably, the first promoter is ammonia added in a form such as ammonium hydroxide. The second promoter is preferably a soluble carbonate such as sodium carbonate, otherwise known as soda ash. In modifications to this preferred approach, other operable reagents are substituted for the first and second promoters. In such modifications, the first promoter may be selected from the group consisting of ammonia, a soluble hydroxide, soluble ammonia salts, and lime. The second promoter may be selected from the group consisting of a soluble carbonate and carbon dioxide gas.

The following examples will serve to illustrate embodiments of the present invention.

EXAMPLES 1–8

In eight separate beneficiations corresponding to examples 1–8 in Tables 1 and 2, 1–2 pounds of dolomitic phosphate ore, having the respective compositions reported as "Feed Assay" in Table 1, was introduced into a batch conditioning and flotation apparatus. The ore feed was previously sized to a nominal maximum 150 micron diameter particle by 20 micron minimum diameter particle size. In some instances no promoters were added, but in other instances sodium carbonate ($Na_2CO_3$), ammonium hydroxide ($NH_4OH$), or combinations thereof were added to the vessel in the amounts indicated in the amounts indicated in Table 1 and admixed with the slurry so that the resulting slurry had about a 40 percent solid content. After a time delay of at least about 1 to 3 seconds after the promoters, the fatty acid collector Paramack WCFA manufactured by Hercules Corporation and fluosilicic acid ($H_2SiF_6$) in the indicated amounts were introduced. The resulting slurry was agitated mechanically and a commercial frothing agent Dowfroth 250 manufactured by Dow chemical Corporation was added. Ambient air bubbles were introduced through the hollow float-cell shaft for about 3 to 10 minutes. During this flotation period separation occurred with the phosphate values remaining in the slurry and a large fraction of the carbonate and magnesium impurities rising to the surface in the froth. The impurities were skimmed from the surface, assayed, and reported as the "Carbonate Float" in Table 2.

In Tables 1 and 2, several shorthand notations are used for compactness in the column headings. "Phos" refers to phosphate, $P_2O_5$. "FluoAcid" refers to fluosilicic acid, $H_2SiF_6$. "SodCarb" refers to sodium carbonate, $Na_2CO_3$.

TABLE 1

| | Feed Assay % | | Reagent, lb/ton ore | | | $NH_4OH$ |
|---|---|---|---|---|---|---|
| Example | MgO | Phos | Fatty Acid | Fluo Acid | Sod Carb | Computed as $NH_3$ |
| 1 | 1.45 | 27.5 | 3.5 | 1.5 | — | — |
| 2 | 1.45 | 27.5 | 1.9 | 1.0 | — | — |
| 3 | 1.45 | 27.5 | 2.5 | 1.0 | — | — |
| 4 | 1.71 | 26.1 | 2.5 | 1.0 | — | 0.7 |
| 5 | 1.71 | 26.1 | 2.0 | 1.0 | 1.0 | — |
| 6 | 2.45 | 20.8 | 2.5 | 1.5 | 1.0 | — |
| 7 | 2.45 | 20.8 | 2.5 | 1.5 | 1.0 | 1.0 |
| 8 | 2.45 | 20.8 | 2.5 | 1.5 | 1.0 | 1.0 |

TABLE 2

| Example | Assay Percent: Carbonate Float MgO | Carbonate Float Phos | Silica Float MgO | Silica Float Phos | Concentrate MgO | Concentrate Phos | Percent Recovery Phos | Percent Rejected MgO |
|---|---|---|---|---|---|---|---|---|
| 1 | 4.3 | 19.0 | 2.2 | 16.2 | 1.2 | 28.9 | 92.2 | 27.2 |
| 2 | 3.7 | 14.9 | 1.2 | 13.5 | 1.4 | 27.8 | 93.2 | 22.3 |
| 3 | 3.5 | 15.0 | 1.6 | 18.0 | 1.1 | 29.0 | 83.0 | 40.0 |
| 4 | 3.8 | 7.0 | 0.96 | 12.3 | 1.1 | 29.2 | 87.0 | 40.6 |
| 5 | 2.8 | 22.1 | 0.52 | 22.2 | 0.5 | 32.8 | 52.2 | 84.1 |
| 6 | 5.9 | 13.7 | 0.76 | 11.4 | 1.3 | 27.6 | 71.8 | 70.4 |
| 7 | 6.0 | 16.6 | 0.29 | 8.2 | 0.39 | 28.4 | 63.7 | 92.4 |
| 8 | 5.6 | 14.3 | 0.28 | 9.3 | 0.37 | 29.0 | 69.2 | 92.3 |

After completion of the carbonate float, Sheerex M70A5 amine was added as a silica collector in the amount of 0.5 pounds per ton ore, under agitation but without any further treatment of the slurry. Additionally, about 0.1–0.5 pounds per ton of kerosene or diesel fuel was added as necessary with the amine to control foam. The slurry was then floated for about 3 to 10 minutes with introduction of ambient air to float the silica materials to the surface, where they were removed for assay and are reported in Table 2 as the "Silica Float." At the completion of this silica flotation, the phosphate concentrate remaining in the slurry was dewatered, samples were taken for assay and the results are reported as "Concentrate" in Table 2.

As observed for examples 1–3 of Table 2, the conventional Bureau of Mines process (i.e., without promoters) achieves a final concentrate of about 28–30 percent phosphate, but the MgO content is not reduced below about 1.1 percent, when the feed ores have 1.45 percent MgO. When ammonium hydroxide is added to a 1.71 percent MgO ore slurry alone as a promoter, example 4, the recovery percentage of phosphate remains high and the rejection rate of MgO is somewhat improved, so that the final product MgO assay is reduced to about 1.1 percent. When sodium carbonate is added alone as a promoter, example 5, the rejection of MgO is increased to about 84 percent, with the resulting final assay being reduced significantly to about 0.5 percent MgO. When both sodium carbonate and ammonium hydroxide are together introduced as promoters prior to the addition of the fatty acid and fluosilicic acid, the magnesium rejection rate surprisingly increases to greater than 90 percent, so that the final product has less than 0.4 percent MgO assay.

The above-described examples were performed in a batch flotation operation, but it is believed that the present invention may be readily applied to continuous beneficiation systems, inasmuch as the Bureau of Mines process has been used successfully in both types of operations.

EXAMPLE 9

Example 7 was repeated, except that the sodium carbonate and ammonium hydroxide additions are made after the fatty acid and fluosilicic acid are added to the vessel. Under these conditions, the promoters are observed to have a reduced beneficial effect.

EXAMPLE 10

Example 7 was repeated, except with the addition of the soluble ammonium salt $NH_4Cl$ in the amount of 1.0 lbs/ton ore, instead of the ammonium hydroxide addition stated in Example 7. The sodium carbonate addition was the same as in Example 7. The percent $P_2O_5$ recovery was 58 percent, and the percent MgO rejection was 66 percent.

EXAMPLE 11

Example 7 was repeated, except with the addition of $Ca(OH)_2$ in the amount of 1.0 lbs/ton ore, instead of the ammonium hydroxide addition stated in Example 7. The sodium carbonate addition was the same as in Example 7. The percent $P_2O_5$ recovery was 60 percent, and the percent MgO rejection was 65 percent. This Example demonstrates that lime is operable as the first promoter, as lime forms $Ca(OH)_2$upon dissolution in water. This Example also demonstrates that soluble hydroxides are operable as the first promoter.

EXAMPLE 12

Example 7 was repeated, except with the addition of the soluble hydroxide NaOH in the amount of 1.0 lbs/ton ore, instead of the ammonium hydroxide addition stated in Example 7. The sodium carbonate addition was the same as in Example 7. The percent $P_2O_5$ recovery was 63 percent, and The percent MgO rejection was 71 percent.

EXAMPLE 13

Example 7 was repeated, except with the addition of the soluble hydroxide KOH in the amount of 1.0 lbs/ton ore, instead of the ammonium hydroxide addition stated in Example 7. The sodium carbonate addition was the same as in Example 7. The percent $P_2O_5$ recovery was 60 percent, and the percent MgO rejection was 60 percent.

EXAMPLE 14

Example 7 was repeated, except with the addition of the soluble carbonate $NH_4HCO_3$ in the amount of 1.0 lbs/ton ore, instead of the sodium carbonate addition stated in Example 7. The ammonium hydroxide addition was the same as in Example 7. The percent $P_2O_5$ recovery was 63 percent, and the percent MgO rejection was 56 percent.

EXAMPLE 15

Example 7 was repeated, except with the addition of $CO_2$ gas in the amount of 1.5 lbs/ton ore, instead of the sodium carbonate addition stated in Example 7. The ammonium hydroxide addition was the same as in Example 7. The percent $P_2O_5$ recovery was 81 percent, and the percent MgO rejection was 50 percent.

Examples 10–15 demonstrate that the use of ammonia, soluble hydroxides, soluble ammonium salts and lime as the first promoter, and the use of soluble carbonates and carbon dioxide as the second promoter, are operable in practicing the invention.

The effect of the promoter addition is dependent upon their order of addition. If, as in Example 9, sodium carbonate and ammonium hydroxide are added after the fatty acid and fluosilicic acid, their beneficial effect is reduced. Moreover, the fatty acid is normally prepared for addition as an emulsion containing ammonium hydroxide, so that ammonium hydroxide is added to the slurry with the fatty acid. Ammonium hydroxide added in this way does not provide the beneficial effects. Preliminary work directed toward adjusting the pH of the slurry in the 5.5–9.2 range also did not yield the beneficial results of the invention. Although the promoters may tend to increase the pH of the slurry, the beneficial effects are not primarily a result of pH modification, as shown by the preliminary work. However, if high dosage rates above those tested are used, some pH modification effect may occur.

In Examples 1–8, the promoters were added about 1–3 seconds prior to adding the fatty acid and fluosilicic acid. This time interval does not appear to be critical, and may be longer or shorter for various other ores and beneficiation processes.

The effective amounts of the promoter additions for ore slurries using ore from, and water available at, J. R. Simplot Company's Conda mine are shown in Table 1. Other work has shown that these quantities may be reduced to about 0.75 lb/ton each for the sodium carbonate and ammonium hydroxide, yet achieve some benefits of the invention. Since ore and water quality vary regionally from mine to mine, lesser or greater amounts of the promoters, and in different relative ratios, may be required to produce the benefits of the invention. Although the above examples relate to a beneficiation process using fluosilicic acid, the invention should not be limited only to processes using fluosilicic acid. Other similar flotation processes using phosphoric acid, di-phosphonic acid and other depressants should also be improved by use of the invention.

Although the above-described examples utilized high-magnesium phosphate ore as feed material, it is believed that the principles of the invention are applicable to the beneficiation of other phosphate ores. For example, when western low-magnesium phosphate ores are used as the feed material, the magnesium reduction should be greater than that reported for the Bureau of Mines process. When the present invention is applied to the beneficiation of other ores, the types, amounts and sequence of promoter additions may be varied within the scope of the invention to account for regional differences in the composition and mineralogical structure of the ores.

It will now be appreciated that, through the use of this invention, promoters may be added to the phosphate feed ore slurry to achieve enhanced reduction of the magnesium content with acceptable phosphate recovery levels in the final concentrate. Furthermore, the addition of the promoters allows greater tolerance of the presence of sub-20 micron particles in the feed slurry. Use of the promoters allows the beneficiation of high-magnesium phosphate ores previously unsuitable for manufacture into phosphoric acid, thereby making available significant additional ore reserves for commercial use.

Although a particular embodiment of the invention is described in detail for purposes of illustration, various embodiments may be made without departing from the spirit and scope of the invention. Accordingly, the invention is not to be limited except as by the appended claims.

What is claimed is:

1. A process for beneficiating a water slurry of a phosphate-containing ore having magnesium and carbonate impurities by separating the fraction of the ore containing those impurities from the fraction of the ore containing the phosphates, the ore having previously been comminuted and sized, comprising the steps of:

adding two promoters to the slurry, to reduce inhibition of phosphate depression and to condition the slurry, the first promoter being selected from the group consisting of ammonia, a soluble hydroxide, a soluble ammonium salt, and lime, and the second promoter being selected from the group consisting of a soluble carbonate and carbon dioxide gas;

adding a fatty acid collection reagent and a phosphate depressant to the slurry, the fatty acid rendering hydrophobic the fraction of the ore containing the magnesium and the carbonates, and the depressant rendering hydrophilic the fraction of the ore containing the phosphates, the addition of collection reagent and depressant to occur shortly after the addition of the two promoters; and separating the fraction of the ore containing the magnesium and the carbonates from the fraction of the ore containing the phosphates by bubbling a gas through the slurry, whereupon the fraction of the ore containing the magnesium and the carbonates floats to the surface in a froth and the fraction containing the phosphates remains in the slurry.

2. The process of claim 1, wherein the first promoter is ammonium hydroxide.

3. The process of claim 1, wherein the second promoter is sodium carbonate.

4. The process of claim 1, wherein the first promoter and the second promoter are added together.

5. A process for beneficiating a slurry of phosphate-containing ore in water, the ore containing magnesium, carbonate and silica impurities, the ore having first been prepared by commiuting and sizing, comprising the steps of:

adding to the slurry under agitation a first promoter selected from the group consisting of ammonia, a soluble hydroxide, a soluble ammonium salt, and lime, and a second promoter selected form the group consisting of a soluble carbonate and carbon dioxide gas, the promoters acting to reduce inhibition of phosphate depression during flotation, so as to enhance flotation of the impurities during subsequent steps;

adding to the agitated slurry fluosilicic acid to depress phosphate flotation and a fatty acid to float carbonates, this addition occurring at least about 1 second after adding the first promoter and the second promoter;

adding a frothing agent to the slurry;

treating the slurry in a flotation unit to remove carbonates and magnesium therefrom in the froth;

adding an amine to the carbonate-depleted slurry to float silicate components; and treating the carbonate and magnesium depleted slurry in a flotation unit to remove silica therefrom in the froth to produce a slurry concentrate, whereby the carbonate and magnesium depleted slurry concentrate contains an enhanced phosphate content and a substantially reduced magnesium, carbonate, and silicate content.

6. The process of claim 5, wherein the first promoter is ammonium hydroxide.

7. The process of claim 5, wherein the second promoter is sodium carbonate.

8. The process of claim 5, wherein the first promoter and the second promoter are added together.

* * * * *